United States Patent [19]

Camacho

[11] Patent Number: 4,718,477

[45] Date of Patent: Jan. 12, 1988

[54] APPARATUS AND METHOD FOR PROCESSING REACTIVE METALS

[75] Inventor: Salvador L. Camacho, Raleigh, N.C.

[73] Assignee: Plasma Energy Corporation, Raleigh, N.C.

[21] Appl. No.: 892,068

[22] Filed: Jul. 30, 1986

[51] Int. Cl.[4] ..... B22D 27/02

[52] U.S. Cl. ..... 164/495; 164/508; 373/23; 373/24

[58] Field of Search ..... 164/469, 470, 494, 495, 164/496, 497, 508, 509, 514, 515; 373/22, 23, 24

[56] References Cited

U.S. PATENT DOCUMENTS

| | | | |
|---|---|---|---|
| 3,147,329 | 9/1964 | Gage | 373/22 |
| 3,429,564 | 2/1969 | Snow | 164/326 |
| 3,479,022 | 11/1969 | Coupette | 266/210 |
| 3,496,280 | 2/1970 | Dukelow et al. | 164/515 |
| 3,673,375 | 6/1972 | Camacho | 219/121 P |
| 3,818,174 | 6/1974 | Camacho | 219/121 P |
| 3,935,371 | 1/1976 | Camacho et al. | 373/18 |
| 4,082,914 | 4/1978 | Bortnichuk et al. | 373/22 |
| 4,107,445 | 8/1978 | Wolf et al. | 373/22 |
| 4,654,076 | 3/1987 | Camacho et al. | 219/121 P |

FOREIGN PATENT DOCUMENTS

| | | | |
|---|---|---|---|
| 2513098 | 9/1976 | Fed. Rep. of Germany | 373/22 |

*Primary Examiner*—Nicholas P. Godici
*Assistant Examiner*—Richard K. Seidel
*Attorney, Agent, or Firm*—Bell, Seltzer, Park & Gibson

[57] ABSTRACT

An apparatus and method is disclosed which is adapted to consolidate and melt reactive metallic materials, and to produce a "first ingot" which is suitable for subsequent evaluation and qualification under existing specifications for such materials in the aerospace industry. The apparatus comprises an enclosed heating chamber adapted to be substantially evacuated of air, and a hearth is positioned within the chamber for supporting the metallic material to be melted. Also, a plasma arc torch is mounted to the heating chamber, which is operable in the transfer arc mode wherein an arc extends from the rear electrode of the torch to the hearth. The rear electrode of the torch is of elongate tubular configuration, which permits a major portion of the length of the arc to be located within the torch itself, which permits the torch to deliver a high level of power in the vacuum environment within the heating chamber.

16 Claims, 6 Drawing Figures

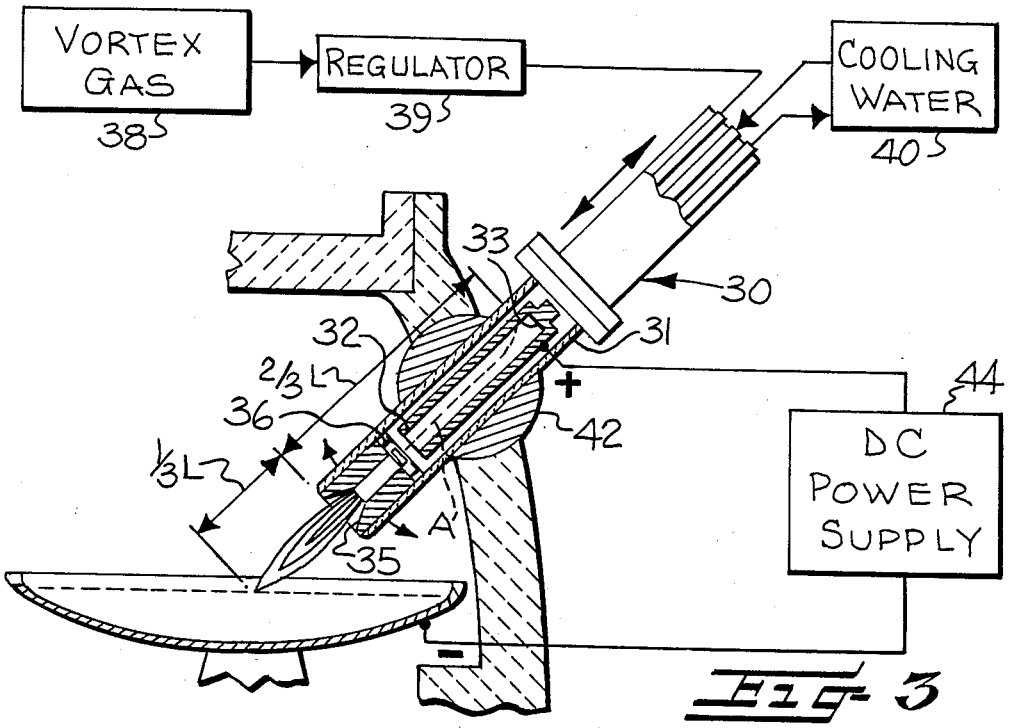
Fig-3
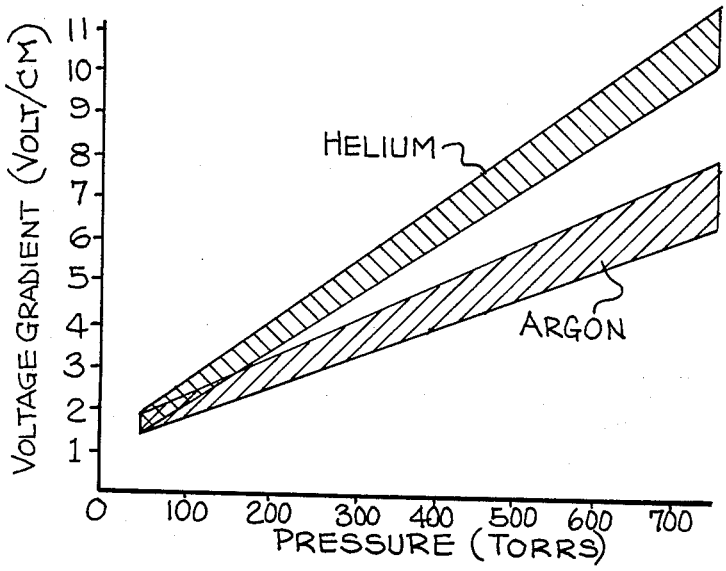
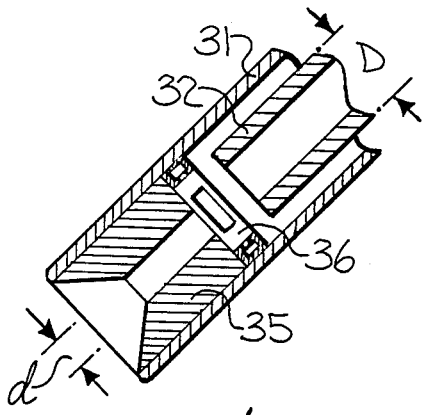
Fig-4
Fig-5
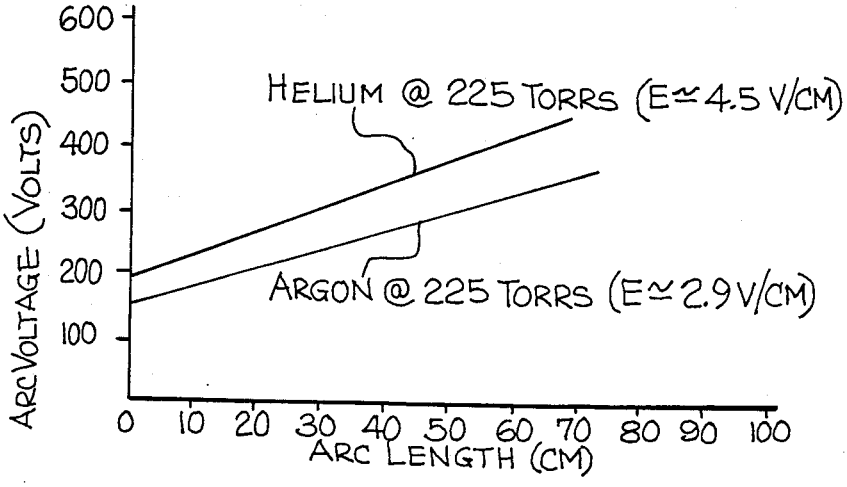
Fig-6

APPARATUS AND METHOD FOR PROCESSING REACTIVE METALS

The present invention relates to an apparatus and method for processing metallic materials, and which is particularly useful in the melting and consolidation of reactive metal materials, including ground ore, sponge metal, scrap, etc.

Titanium, zirconium, and certain other metals are commonly referred to as reactive metals, in view of the fact that they tend to rapidly react or explode when heated in the presence of certain gases. As a result, the melting of such metals must be carefully controlled, and conventionally, the melting and consolidation of reactive metals is conducted in a vacuum furnace wherein the heat is supplied by an electron beam. The use of an electron beam possesses a number of disadvantages however, including the fact that a high level of vacuum is required to sustain the beam, and the required high vacuum level is expensive and it may also result in some of the alloying elements being vaporized and lost. Also, conventional electron beam heaters are not effective in heating the melt if the pool depth is more than about one inch, and thus the pool is necessarily very shallow. This in turn renders the gravity separation of contaminating high density inclusions more difficult.

In an attempt to reduce to required vacuum level, and eliminate the other disadvantages of electron beam heaters, it has been proposed to utilize a plasma arc torch in a reactive metal furnace, note for example the U.S. Pat. to Snow, No. 3,429,564. However, the prior processes utilizing plasma arc torches have not been altogether satisfactory, since such torches commonly utilize an internal tungsten electrode, and the tungsten tends to erode during operation and contaminate the metal being processed. In addition, a significant obstacle to the use of a plasma torch in a vacuum environment is the fact that the voltage gradient (arc voltage divided by arc length) is much lower than the voltage gradient when the torch is operated at atmospheric pressure. Since the voltage gradient is a measure of the available output power of the torch for a given arc lenth, it will be apparent that the available output power of the torch is significantly reduced in the vacuum environment, to the point where the power might not be adequate to effectively melt the raw materials. It is also recognized that the power level is proportional to the length of the arc, and in normal environments at atmospheric pressure, the power level can be increased by increasing the arc length. However, in a vacuum environment, the voltage gradient may be so low that an increase in arc length provides very little increase in power.

It is accordingly an object of the present invention to provide an apparatus and method for melting reactive metals which overcomes the deficiencies and limitations of the prior art as noted above.

It is also an object of the present invention to provide an apparatus and method for melting reactive metals which utilizes a plasma arc torch for melting the metal, as opposed to an electron beam heater, and which is operable under partial vacuum conditions and at a pressure well above the vacuum conditions required for an electron beam heater. The higher operating pressure not only permits the cost of the heating chamber to be reduced, but also the problem associated with the vaporization and loss of alloys is avoided.

It is also an object of the present invention to provide an apparatus and method for melting reactive metals utilizing a plasma arc torch in a vacuum environment, which eliminates tungsten contamination of the melt, and wherein the power output of the torch is sufficiently high in the vacuum environment to provide the required power level and heating capacity, and such that the torch is able to heat a metal pool having a depth of several inches to thereby facilitate the gravity separation of high density inclusions.

These and other objects and advantages of the present invention are achieved in the embodiment illustrated and described herein, and which involves the discovery that in operating a plasma arc torch in a vacuum environment, the low voltage gradient of the arc, and thus the reduced power capacity of the torch, can be more than compensated for by elongating the arc within the torch itself and where the voltage gradient is higher by reason of the relatively high gas pressure inside the torch. More particularly, and in accordance with the present invention, an apparatus and method for melting a reactive metal or the like are provided, and which include an enclosed heating chamber, a hearth positioned within the chamber for supporting a molten metal, and means for substantially evacuating the heating chamber. Also, a plasma arc torch is provided which comprises a torch housing, a rear electrode mounted within the housing and comprising a tubular elongate metal member having a closed inner end and an open outer end, a collimating nozzle comprising a tubular metal member having a bore therethrough and mounted within the housing in coaxial alignment with the rear electrode, and vortex generating means for generating a vortical flow of a gas at a location intermediate the rear electrode and collimating nozzle. Also, power supply means is operatively connected to the rear electrode and to the hearth, for operating the torch in a transfer arc mode wherein the arc extends from the bore of the rear electrode through the collimating nozzle and to the hearth. In operation, the vortex gas flow rate and the power supply are coordinated with respect to the axial position of the torch with respect to the hearth, such that the arc attaches adjacent the closed inner end of the rear electrode and the arc extends from the rear electrode forwardly to the hearth and has at least about one half of its length within the torch. Preferably, the diameter of the bore of the collimating nozzle is substantially less than the diameter of the bore of the rear electrode, which serves to increase the gas pressure within the rear electrode, and which in turn assists in causing the arc attachment point to be located adjacent the closed inner end of the rear electrode.

Some of the objects and advantages of the present invention having been stated, others will appear as the description proceeds, when taken in conjunction with the accompanying drawings, in which FIG. 1 is a perspective view, with parts broken away, of an apparatus for melting reactive metals which embodies the features of the present invention;

FIG. 3 is an enlarged fragmentary view of a portion of FIG. 2 and illustrating the internal components of the torch;

FIG. 4 is an enlarged fragmentary cross-sectional view of the forward portion of the torch shown in FIG. 3;

FIG. 5 is a plot of voltage gradient versus vacuum level for two gases, helium and argon; and FIG. 6 is a plot of arc length versus arc voltage for helium and argon at a pressure of 225 torrs.

Figure 1:
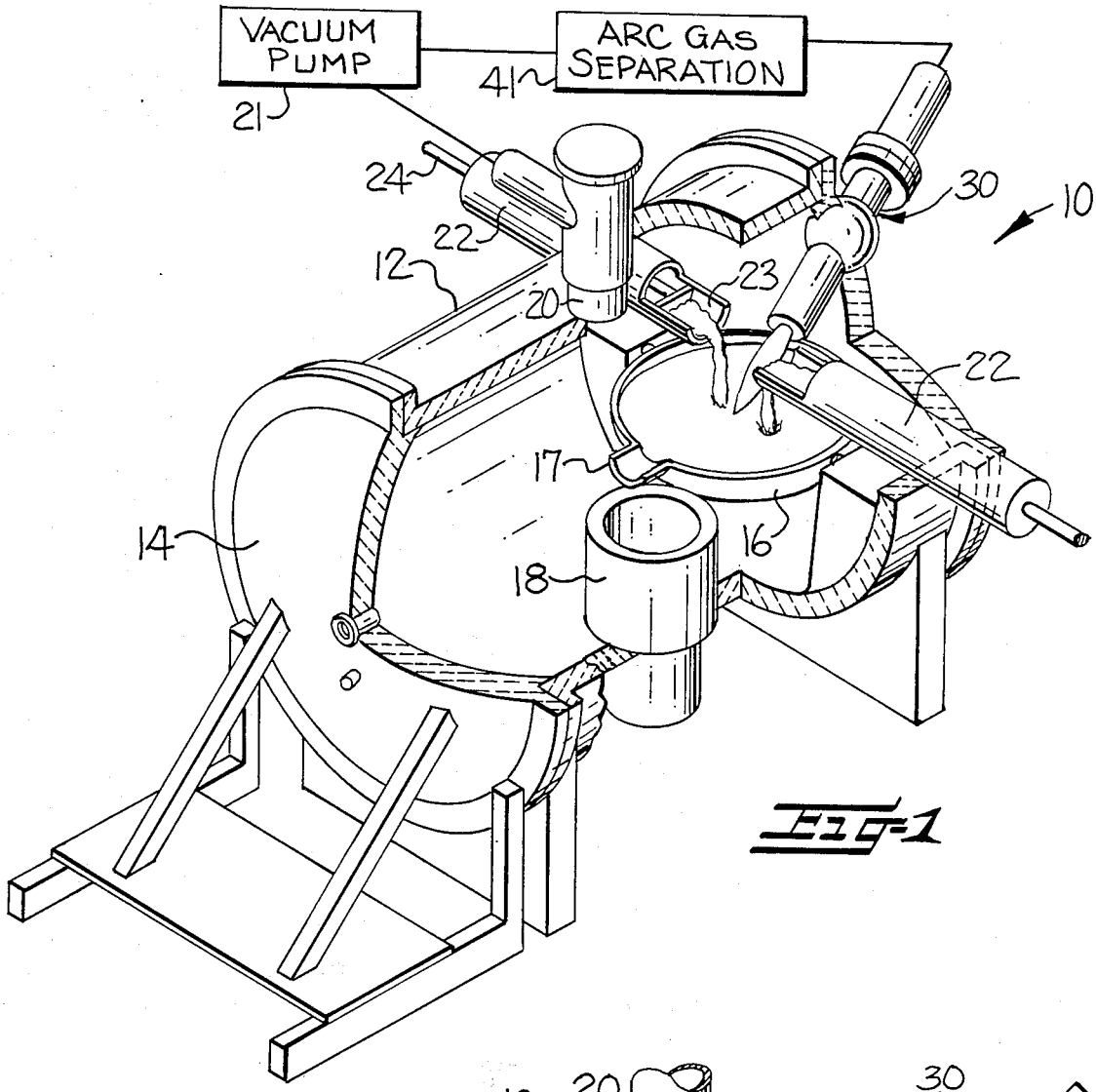
Figure 2:
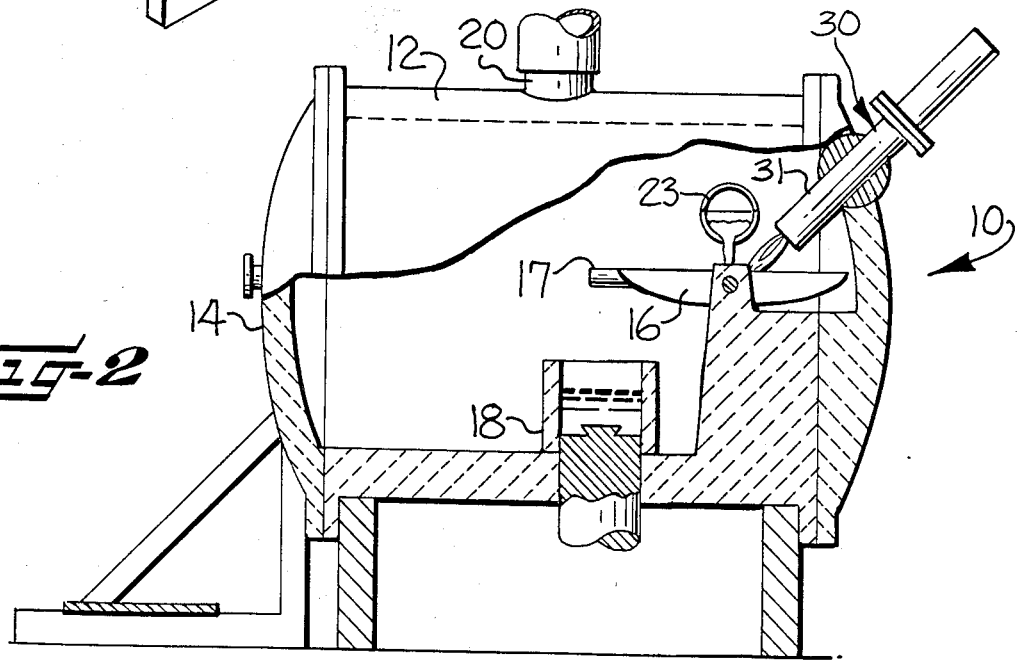
FIG. 2 is a sectional side elevation view of the apparatus shown in FIG. 1.

Referring more particularly to FIGS. 1 and 2, an apparatus embodying the features of the present invention is generally indicated at 10, and comprises an enclosed and air tight heating chamber 12. The chamber 12 includes a generally cylindrical wall which is horizontally oriented, and in one specific embodiment, the chamber has a diameter of about eight feet and is about ten feet in length. Also, the wall of the chamber 12 may be water cooled by a suitable water circulation system (not shown). One end of the chamber is closed by a circular door 14, which may be withdrawn to permit access to the interior thereof.

Within the heating chamber, there is mounted a dish-shaped, water-cooled copper hearth 16. The hearth includes a pouring lip 17 along one side edge, and the hearth is mounted for selective pivotal movement to permit pouring of a melted material into an underlying mold 18. As best seen in FIG. 2, the mold 18 may be of a bottom withdrawal type, and wherein the ingot is continuously withdrawn downwardly as the mold is filled and the metal solidifies. The hearth 16 also includes copper tubing (not shown) welded to the bottom surface thereof, so that the hearth may be water cooled. Also, the mold may be similarly cooled by a circulating water system. In a specific embodiment, the hearth has a diameter of about thirty inches, and is about six inches deep, with the pour lip 17 positioned at the three inch level. This depth of the hearth is sufficient to permit contaminating high density inclusions to separate to the bottom thereof by gravity, and so that the risk of pouring the inclusions into the mold 18 is effectively minimized.

The heating chamber 12 further includes an exhaust port 20 having a suitable vacuum pump 21 connected thereto. Also, a pair of material feed ports 22 extend through the opposite side walls of the chamber, with the feed ports including a tray 23 for supporting the material to be melted, as well as a pusher rod 24 by which the material may be periodically advanced so that it falls into the underlying hearth.

A plasma arc torch 30 of the transfer arc type is mounted in the wall of the heating chamber, and as best seen in FIG. 3, the torch comprises a torch housing 31, a rear electrode 32 mounted within the housing and comprising an elongate tubular metal member having a closed inner end 33 and an open outer end. Preferably, the rear electrode 32 is composed of an integral piece of copper. A collimating nozzle 35 comprising a tubular metal member having a bore therethrough is mounted within the housing 31 and in axial alignment with the open end of the rear electrode. Also, vortex generating means for generating a vortical flow of a gas at a location intermediate the rear electrode and the nozzle is also provided. The vortex generating means includes a hollow annular ring 36 adjacent the nozzle 35 having tangentially directed openings on its inside surface. Also, there is provided a source 38 of gas, which is typically helium or argon, and a regulator 39 for controlling the flow rate into the ring 36 and thus into the torch. As best seen in FIG. 4, the diameter d of the bore of the collimating nozzle 35 is substantially less than the diameter D of the bore of the rear electrode 32, for the reasons set forth below.

Water is required to cool the torch, and the torch includes an internal water circulation system which is schematically illustrated at 40 in FIG. 3. Also, an arc gas recovery system 41 (FIG. 1) of conventional design may be mounted within the exhaust duct, whereby at least a portion of the arc gas may be recovered and recycled to the torch. Further details regarding the vortex generating means and the water cooling system may be obtained by reference to the U.S. Pat. to Camacho Nos. 3,673,375 and 3,818,174, the disclosures of which are incorporated by reference.

The torch 30 is mounted adjacent one end of the heating chamber by means of a ball actuator 42, which permits in and out axial movement to adjust the separation distance from the hearth, as well as sideways or lateral movement in at least two planes. Also, the torch is mounted so that the plasma column is disposed at an angle of about 60° with respect to the plane of the hearth.

The apparatus of the present invention also includes power supply means 44 which is operatively connected to the rear electrode and to the hearth, for operating the torch is a transfer arc mode wherein an arc A extends from the bore of the rear electrode 32 through the collimating nozzle 35 and to the hearth 16. In one embodiment, the power supply means 44 is designed to convert three-phase alternating current into a controlled DC power, with the anode connected to the rear electrode 32 and the cathode connected to the hearth 16. As a specific example, the power supply may be designed to accept three-phase, 600 volts, 60 Hertz power, which is converted to 500–750 kw of DC power. The arc current is set and controlled at a control panel, which the arc length and arc gas are regulated to determine the arc voltage.

As an important aspect of the present invention, the rear electrode 32 of the torch 30 has an elongate cylindrical configuration, with the ratio of its bore length to its internal diameter D being at least about ten, and preferably greater than twenty. As a specific example, the electrode 32 may have an internal bore length of about 30 inches, and an internal diameter of about 1.125 inches, and in this example the ratio of bore length to diameter D is about 26.7. Also, the torch 30 is operated such that the arc attaches within the bore at a point closely adjacent the inner end 33 of the electrode, and such that at least about one half the length of the arc which extends from the rear electrode to the hearth is located within the torch. Most preferably, about two thirds or more of the length L of the arc A is located within the torch, as indicated schematically in FIG. 3.

The fact that the diameter d of the nozzle 35 is less than the diameter D of the bore of the rear electrode, results in a restriction in the flow of the vortex gas outwardly through the nozzle 35. This in turn increases the pressure of the gas within the rear electrode, which has been found to assist in causing the arc attachment point to move rearwardly and be located adjacent the closed inner end 33 of the rear electrode. Preferably, the ratio of D/d is about 1.5, and in the above example where the diameter D is 1.125 inches, the diameter d is preferably about 0.75 inches.

The significance of operating the torch so that a high percentage of its arc length is within the torch 30, may be demonstrated from FIGS. 5 and 6. FIG. 5 represents a plot of the voltage gradient versus vacuum level for helium and argon. As will be seen, at atmospheric pressure of about 760 torrs, an arc will have a voltage gradient of about 10–11 volts per centimeter in a helium environment, and it will be about 6–8 volts per centimeter in an argon environment. With a drop in pressure however, the voltage gradient significantly drops. Thus for example, at 225 torrs, the voltage gradients for helium and argon will be about 4.5 and 2.9 respectively, and as will be seen in FIG. 6, the slope of the plot of the arc length versus arc voltage is quite flat at this pressure level, so that a change in arc length has very little change in arc voltage, and thus delivered power. At lower pressures, which is where processing of reactive metals often occurs, the curve will be even more flat, and a change in arc length will have even less influence on the power level. This produces a crisis at high vacuum levels, since the arc length cannot be extended the distance necessary to supply sufficient power and heat in order to melt the metallic material.

The solution to this problem in accordance with the present invention lies in the recognition that relatively high pressure is present within the torch itself by reason of the introduction of the vortex gas, and this pressure level may be increased by the restriction caused by the D/d ratio as described above. Also, by utilizing a rear electrode 32 which is in the form of an elongate tube, and by coordinating the gas flow rate and current level, the pressure in the torch may be controlled and the arc may be made to attach at a point adjacent the inner end 33 of the rear electrode. Thus the arc length may be extended within the torch itself, where relatively high pressure exists, and this internal portion of the arc has a relatively high voltage gradient and is able to compensate for the loss of the voltage gradient in the vacuum existing outside of the torch.

A specific example of a process involving the melting and consolidation of titanium scraps in accordance with the present invention will now be described. The heating chamber 12 as described above was fitted with a torch 30 having an operating power range of 100 kw to 1500 kw. The rear electrode 32 of the torch was formed of an integral copper tube having a closed inner end, a bore length of about 30 inches, and a diameter D of 1.125 inches. The diameter d of the nozzle 35 was 0.75 inches, and the axial length of the nozzle 35 and vortex generator 36 was about five inches total. Titanium scraps of various sizes and shapes were fed onto the hearth 16, and the chamber 12 was evacuated to a pressure of about 225 torrs. The plasma torch 30 was then operated at about 500 kw, with the flow rate of the vortex gas being set at 60 scfm, and being cyclically varied from that value±20%, so as to vary between about 48 to 72 scfm. The arc attached within the inner end portion of the rear electrode 32, and moved axially approximately ten inches in accordance with the pressure variation, to thereby spread out the resulting erosion of the bore of the electrode. The center of the moving arc attachment point was about five inches from the closed inner end 33 of the rear electrode. The front end of the torch was located about 18 inches from the hearth during operation, so that the total arc length was about 48 inches, which included an average of 25 inches within the rear electrode, 5 inches through the vortex generator ring 36 and nozzle 35, and 18 inches to the hearth. Thus 30 inches of the total arc length of 48 inches, i.e. 62.5% of the total length, was located within the torch.

The torch 30 was laterally moved in its mounting 42 during operation to increase the area of the melt zone in the hearth, and upon the scrap being melted, the hearth 16 was tipped to deliver the molten metal to the underlying mold 18. The process was repeated until the mold was filled, which resulted in the production of a 6000 pound ingot, which was suitable for evaluation and qualification as a "first ingot" under existing reactive metal processing specifications used by the aerospace industry.

In the drawings and specification, there has been set forth a preferred embodiment of the invention, and although specific terms are employed, they are used in a generic and descriptive sense only and not for purposes of limitation.

That which I claim is:

1. An apparatus adapted for melting a reactive metal and the like, and comprising an enclosed heating chamber, a hearth positioned within said chamber for supporting a molten metal, means for substantially evacuating said heating chamber, a plasma arc torch including a torch housing, a rear electrode mounted within said housing and comprising an elongate tubular metal member having an internal bore and a closed inner end and an open outer end, with said internal bore having an axial length which is at least about ten times its diameter, a collimating nozzle comprising a tubular metal member having a bore therethrough, said nozzle being mounted within said housing and in coaxial alignment with said rear electrode, and vortex generating means for generating a vortical flow of a gas at a location intermediate said rear electrode and said nozzle, means mounting said torch to said heating chamber at a predetermined distance from said hearth, and power supply means operatively connected to said rear electrode and to said hearth for operating said torch in a transfer arc mode wherein an arc extends from said bore of said rear electrode through said collimating nozzle and to said hearth, and wherein said vortex generating means and said power supply means may be coordinated such that the arc attaches adjacent the closed inner end of said bore of said rear electrode and at least about one half the length of the arc extending from said rear electrode to said hearth is located within the torch.

2. The apparatus as defined in claim 1 wherein the diameter of said bore of said collimating nozzle is substantially less than the diameter of said bore of said rear electrode, and so as to increase the pressure of the vortex gas within the bore of said rear electrode.

3. The apparatus as defined in claim 2 wherein said apparatus further includes a water-cooled mold mounted with said chamber, and wherein said hearth is pivotally mounted to permit selective pouring of a molten metal into said mold.

4. The apparatus as defined in claim 2 wherein said heating chamber includes door means for permitting selective access to the interior of said chamber and said mold.

5. The apparatus as defined in claim 2 wherein said means for substantially evacuating said heating chamber includes means for collecting the gas introduced into said heating chamber by said vortex generating means of said torch, and for recycling such gas to said vortex generating means.

6. The apparatus as defined in claim 2 further comprising raw material feeding means positioned within said heating chamber for selectively delivering raw material onto said hearth.

7. The apparatus as defined in claim 2 wherein said means mounting said torch to said heating chamber maintains said torch at an angle of about 60° with respect to the plane of said hearth.

8. The apparatus as defined in claim 2 wherein said torch is adjustably mounted to said heating chamber for selective axial movement toward and away from said hearth, and for selective lateral movement with respect to said hearth.

9. The apparatus as defined in claim 2 wherein said power supply means comprises a direct current source, with the anode thereof connected to said rear electrode and the cathode thereof connected to said hearth.

10. A method of melting a reactive metallic material or the like, and comprising the steps of providing an enclosed heating chamber having a hearth positioned therein for receiving a metallic material to be melted, and a plasma arc torch which comprises a torch housing, a rear electrode mounted within said housing and comprising an elongate tubular metal member having an internal bore and a closed inner end and an open outer end, a collimating nozzle comprising a tubular metal member having a bore therethrough and mounted within said housing in coaxial alignment with said rear electrode, and vortex generating means for generating a vortical flow of a gas at a location intermediate said rear electrode and collimating nozzle, providing a power supply means which is operatively connected to said rear electrode and to said hearth, placing a metallic material to be melted on said hearth and drawing a partial vacuum within said heating chamber, and operating said power supply means so that a heated plasma arc column extends from the bore of said rear electrode through said collinating nozzle and to said hearth and contacts and heats the metallic material on the hearth, and including coordinating the gas flow rate of said gas vortex generating means and the power level of said power supply means with the axial separation between said torch and said hearth such that the arc extends from a point adjacent the closed inner end of said bore of said rear electrode through said collimating nozzle and to said hearth, and with at least about one half of the length of the arc being located within the torch, and while restricting the flow of the vortex gas outwardly through the collimating nozzle so as to increase the pressure of the gas within the rear electrode and to thereby assist in causing the arc attachment point to be located adjacent the closed inner end of said rear electrode.

11. The method as defined in claim 10 comprising the further step of periodically tilting the hearth so as to deliver the melt thereon to an underlying mold.

12. The method as defined in claim 11 comprising the further step of collecting the gas introduced into the heating chamber by said vortex generating means of said torch, and recycling such gas to said vortex generating means.

13. The method as defined in claim 10 wherein the vacuum within said heating chamber is within a range of between about 225 to 600 torrs.

14. The method as defined in claim 10 wherein the metallic material is selected from the group consisting of titanium and zirconium.

15. The method as defined in claim 10 wherein the step of operating said torch includes operating said torch such that about two thirds of the length of the arc is located within the torch.

16. The method as defined in claim 10 wherein the step of operating said power supply means includes connecting said rear electrode to the anode of a direct current power supply, and connecting said hearth to the cathode of said direct current power supply.

* * * * *